US010421641B2

(12) United States Patent
Manner et al.

(10) Patent No.: US 10,421,641 B2
(45) Date of Patent: Sep. 24, 2019

(54) ELEVATOR CAR AND ELEVATOR

(71) Applicants: Timo Manner, Klaukkala (FI); Nithil Karimpanackal Natarajan, Helsinki (FI); Seppo Kolehmainen, Hyvinkaa (FI); Jouni Lappalainen, Jokela (FI); Razvan Albu, Vantaa (FI); Tuuli Somma, Helsinki (FI); Petri Koli, Hyvinkaa (FI)

(72) Inventors: Timo Manner, Klaukkala (FI); Nithil Karimpanackal Natarajan, Helsinki (FI); Seppo Kolehmainen, Hyvinkaa (FI); Jouni Lappalainen, Jokela (FI); Razvan Albu, Vantaa (FI); Tuuli Somma, Helsinki (FI); Petri Koli, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 1079 days.

(21) Appl. No.: 14/317,843

(22) Filed: Jun. 27, 2014

(65) Prior Publication Data

US 2014/0305749 A1 Oct. 16, 2014

Related U.S. Application Data

(63) Continuation of application No. PCT/FI2012/051261, filed on Dec. 18, 2012.

(30) Foreign Application Priority Data

Dec. 30, 2011 (FI) ..... 20110432

(51) Int. Cl.
*B66B 11/02* (2006.01)

(52) U.S. Cl.
CPC ..... *B66B 11/0226* (2013.01); *B66B 11/024* (2013.01); *B66B 11/0206* (2013.01); *B66B 11/0233* (2013.01)

(58) Field of Classification Search
CPC ..... B66B 11/0226; B66B 11/0233; B66B 11/024; B66B 11/0253
See application file for complete search history.

(56) References Cited

U.S. PATENT DOCUMENTS 2,300,449 A * 11/1942 Rowe ..... B61D 5/002 105/423
4,357,993 A 11/1982 Halpern et al.
(Continued)

FOREIGN PATENT DOCUMENTS

CA 2459638 A1 9/2004
CN 1241526 A 1/2000
(Continued)

OTHER PUBLICATIONS

Office action for corresponding Chinese Application No. 20128006650583 dated Jul. 14, 2015 and English and translation thereof.

(Continued)

*Primary Examiner* — Minh Truong
(74) *Attorney, Agent, or Firm* — Harness, Dickey & Pierce, P.L.C.

(57) ABSTRACT

An elevator car includes a car box. The car box includes a frame structure that includes a floor element, vertical beams connected to the floor element, and roof beams connected to the vertical beams. The car box further includes walls, each including wall elements of rectangular shape fixed side-by-side to the frame structure and extending from one edge side of the car box to another. The car box includes a roof including roof elements of rectangular shape fixed side-by-side to the frame structure and extending from one edge side of the car box to another. The car box includes and interior bounded by at least the floor element, the walls, and the roof. At least on set of elements, of the roof elements and the wall (Continued)

elements, includes elements associated with separate, respective integrated functionalities.

17 Claims, 3 Drawing Sheets

(56) References Cited

U.S. PATENT DOCUMENTS

| | | | | |
|---|---|---|---|---|
| 4,462,193 | A * | 7/1984 | Ericson | B66B 11/0253 24/306 |
| 4,635,756 | A * | 1/1987 | Sherwood | B66B 11/0226 187/401 |
| 4,711,322 | A * | 12/1987 | Orndorff | E04B 9/18 187/401 |
| 4,875,553 | A | 10/1989 | Smith et al. | |
| 5,145,247 | A * | 9/1992 | Mandy | B66B 11/0233 362/148 |
| 5,975,249 | A * | 11/1999 | Tomaseti | B66B 11/0226 187/401 |
| 6,209,686 | B1 | 4/2001 | Tomasetti et al. | |
| 6,550,586 | B1 * | 4/2003 | Takeuchi | B66B 1/462 187/391 |
| 7,089,708 | B1 * | 8/2006 | Bostock | B66B 11/0253 52/392 |
| 8,104,587 | B2 | 1/2012 | Starace | |
| 8,468,767 | B1 * | 6/2013 | McBride | E04B 1/40 52/461 |
| 2003/0006102 | A1 | 1/2003 | Bloch | |
| 2004/0195049 | A1 | 10/2004 | Stobo et al. | |
| 2006/0175148 | A1 | 8/2006 | Starace | |
| 2006/0215399 | A1 * | 9/2006 | Endo | B66B 11/0233 362/231 |
| 2007/0181380 | A1 * | 8/2007 | Bostock | B66B 11/0253 187/401 |
| 2007/0181383 | A1 * | 8/2007 | Bizarria Santos | B66B 11/0253 187/401 |
| 2007/0251767 | A1 * | 11/2007 | Yoon | B66B 11/0226 187/401 |
| 2009/0057070 | A1 * | 3/2009 | Maury | B66B 11/0226 187/401 |
| 2012/0223642 | A1 * | 9/2012 | Amano | B66B 1/34 315/77 |

FOREIGN PATENT DOCUMENTS

| | | | |
|---|---|---|---|
| EP | 0566424 | A1 | 10/1993 |
| EP | 1031527 | A1 | 8/2000 |
| EP | 1970341 | A1 | 9/2008 |
| EP | 1982944 | A1 | 10/2008 |
| JP | 63190181 | | 7/1988 |
| JP | 4-116083 | A | 4/1992 |
| WO | WO-9933743 | A1 | 7/1999 |
| WO | WO-2006126254 | A1 | 11/2006 |
| WO | WO-2008107202 | A1 | 9/2008 |

OTHER PUBLICATIONS

European Search Report dated Aug. 7, 2015 issued in corresponding European Patent Application No. 12862514.2.
International Search Report for PCT/FI2012/051261 dated Apr. 12, 2013.
Finnish Search Report for FI20110432 dated Oct. 17, 2012.

* cited by examiner

ELEVATOR CAR AND ELEVATOR

This application is a continuation of PCT International Application No. PCT/F12012/051261 which has an International filing date of Dec. 18, 2012, and which claims priority to Finnish patent application number 20110432 filed Dec. 30, 2011, the entire contents of both which are incorporated herein by reference.

FIELD OF THE INVENTION

The object of the invention is an elevator car and an elevator, more particularly an elevator car and an elevator applicable to the transporting of people and/or of freight.

BACKGROUND OF THE INVENTION

Elevator cars are conventionally formed to comprise a car box and suspension means, which suspension means comprise hoisting roping and a load-bearing frame, which comprises a lower horizontal beam system, an upper horizontal beam system, and also a vertical beam system of a first side and a vertical beam system of a second side, which beam systems are connected to each other so that they form a closed ring, inside which is an interior comprised in a car box fixed to the beam systems, which interior can receive freight and/or passengers for conveying them in the interior of the elevator car.

Conventionally the car box of an elevator has been essentially fully inside the aforementioned ring. Also known in the art are elevator cars, in which the beams participating in forming the ring structure of the aforementioned load-bearing frame are integrated as a part of the wall structures, roof structures or floor structures bounding the interior of the car box. This type of solution is presented in, among others, publications EP1970341 and WO9933743. Utilizing the solutions, a shallow roof structure for an elevator car can be achieved. The vertical space usage is very efficient, but nevertheless some free space remains unutilized and modification of the elevator car according to site regulations and customer needs is not possible.

The outer surface of the roof of an elevator car is generally formed from plates that are firmly and rigidly supported on the upper horizontal beam system. According to prior art, there is a separate ceiling panel in the elevator cars, below the upper horizontal beam system and the aforementioned plates forming the outer surface. The roof panel can be a single-piece or multi-piece roof panel, and the bottom surface of it forms a planar surface bounding the interior of the car. The roof panel is generally a plate-type structure that is quite thin in terms of its thickness, into which luminaires are sunk. The ceiling panel structure has increased the total thickness of the roof structure by the amount of its own thickness plus possible fastening clearances. Using this type of conventional method in connection with solutions according to prior art produces an unnecessarily thick, heavyweight and technically complex roof entity that is expensive in terms of its manufacturing costs.

GENERAL DESCRIPTION OF THE INVENTION

The aim of the invention is to eliminate, inter alia, the aforementioned drawbacks of prior-art solutions. More particularly the aim of the invention is to produce an elevator, the structure of the elevator car of which is light and easily adaptable according to the needs of the operating site. The aim of the invention is further to produce one or more of the following advantages, among others:

- An elevator is achieved wherein the structure of the elevator car is simple and enables parametric design of the elevator car for elevators of different sizes.
- An elevator is achieved wherein the joint surfaces of wall elements, roof elements and floor elements of the car box of the elevator car and the fixing of the car box to the frame structure is harmonized for connecting elements of different types and manufactured from different materials to the car box.
- An elevator is achieved wherein the structure of the elevator car is cheaper than before to manufacture and is optimized for the operating site.
- An elevator is achieved, the materials of the wall elements of the car box of the elevator car of which can be selected according to the regulations and needs of the installation site.
- An elevator is achieved wherein the distribution direction of the wall elements of the car box of the elevator car can easily be changed from vertical to horizontal without significant changes to the frame structure of the car box.
- An elevator is achieved, the space usage of the roof structure of the elevator car of which is more efficient than before.
- An elevator is achieved, the wall structure and/or roof structure of the car box of the elevator car of which is composed of elements having different functionalities and is adaptable according to the regulations of the operating site by modifying the elements and the sequence of them with respect to each other.

The invention is based on the concept that the elevator car comprises suspension means for supporting the elevator car in the elevator hoistway and a car box to be assembled according to site regulations and customer needs, which car box comprises a free interior for receiving and transporting freight and/or passengers in the interior of the car box of the elevator, which interior is bounded by at least the floor, walls, roof, and preferably also door arrangement comprised in the car box, a floor element, vertical beams and roof beams, which floor element and vertical beams and roof beams are connected to each other such that they form a load-bearing frame structure, of rectangular prism shape, of the car box of the elevator, on the inside of which frame structure is a plurality of planar elements of rectangular shape fixed side-by-side to the frame structure and extending essentially from one edge side of the car box to another, from which plurality a uniform wall surface and/or roof surface of the car box is formed, and the plurality of which elements comprises elements differing to each other in respect of the functionalities integrated into the elements.

In one basic embodiment of the concept according to the invention the elevator comprises an elevator hoistway, and an elevator car arranged to move in the elevator hoistway, which elevator car comprises

- suspension means, which suspension means comprise hoisting roping and a load-bearing frame, inside which is an interior comprised in a car box fixed to the beam systems,
- a frame structure of the car box, which comprises
  - a floor element, which comprises an upward opening rectangular floor surface of the car box and also fixing surfaces essentially in the direction of the vertical plane disposed on the side edges of the floor element for fixing the aforementioned vertical beams to the floor element, the vertical beams of a first side and the vertical beams of a second side and two parallel first horizontal elongated roof beams in connection with the roof and fixed to the vertical beams, and two parallel second horizontal elongated roof beams at a distance from each other and essentially orthogonal to them, which adjacent roof beams are rigidly fixed to each other, and an interior, which is bounded by a car box, which comprises a floor element and a plurality of planar elements of rectangular shape extending essentially from one edge side of the car box to another, from which plurality a uniform wall surface and/or roof surface of the car box is formed, and the plurality of which elements comprises elements differing to each other in respect of the functionalities integrated into the elements.

In this way the aforementioned advantages are achieved.

In a more refined embodiment of the concept according to the invention the aforementioned load-bearing frame and the car box are separate from each other and the load-bearing frame is fixed to the car box essentially via the floor element.

In a more refined embodiment of the concept according to the invention the aforementioned load-bearing frame is integrated into the car box, in which case at least the floor element forms a part of the load-bearing frame.

In a more refined embodiment of the concept according to the invention the frame structure of the car box of the elevator car comprises a floor element, above which is the aforementioned interior and which floor element rigidly connects the aforementioned vertical beams and on which floor element means, such as diverting pulleys or rope clamps, for connecting the hoisting ropes to the elevator car are supported.

In a more refined embodiment of the concept according to the invention the aforementioned frame structure of the car box of the elevator car comprises the vertical beam(s) of a first side and the vertical beam(s) of a second side, between which is the aforementioned interior, and which beams are rigidly connected to each other by the aid of the aforementioned roof beams.

In a more refined embodiment of the concept according to the invention the aforementioned frame structure of the car box of the elevator car comprises the vertical beam(s) of a first side and the vertical beam(s) of a second side, which are disposed in the corners of the rectangularly-shaped floor element and together with the floor element form the edge sides of a frame structure of rectangular prism shape.

In a more refined embodiment of the concept according to the invention the aforementioned vertical beams are profile beams, preferably open L-profile beams or C-profile beams, or closed profile beams, which profile beams have essentially the same continuous cross-sectional profile in the longitudinal direction of the beam, the width/height ratio of which cross-section is preferably at least 0.5, preferably 0.5-1, more preferably 0.7-0.9. The cross-sectional profile continues as such preferably for essentially the whole length of the beam. One advantage is a rigid structure, and enables the fixing of the roof beams and other necessary structural elements, such as horizontal support elements for the wall elements, to the vertical beams.

In a more refined embodiment of the concept according to the invention the aforementioned roof beams are profile beams, preferably open L-profile beams or C-profile beams, or closed profile beams, which profile beams have essentially the same continuous cross-sectional profile in the longitudinal direction of the beam, the width/height ratio of which cross-section is preferably at least 0.5, preferably 0.5-1, more preferably 0.7-0.9. The cross-sectional profile continues as such preferably for essentially the whole length of the beam. One advantage is a rigid structure, which is shallow, and enables the fixing of necessary structural elements, such as vertical stiffeners, to the roof beams.

In a more refined embodiment of the concept according to the invention the aforementioned floor element is a planar sandwich structure having a rectangular shape and metal surface, in which the core material of the sandwich board is a honeycomb structure, preferably a metallic flute profile, more preferably a honeycomb fabricated from thermoplastic, such as e.g. a polypropylene honeycomb. The surface plates of the sandwich board are fixed to the core material by welding, glueing or riveting, depending on the materials used. The surface plates are preferably metal material, most preferably aluminium, of a thickness of preferably 0.5-5 mm, even more preferably 0.7-3 mm, most preferably 1-2 mm. The thickness of the core material of the sandwich board is preferably 10-100 mm, even more preferably 15-50 mm, most preferably 20-30 mm.

In a more refined embodiment of the concept according to the invention metallic U-profile elements, in which apertures are arranged for joint elements, are connected to the side edges of a sandwich-structured floor element of rectangular shape. A plate element, preferably a plywood board, essentially the size of the floor element is connected to the surface of the aforementioned sandwich board on the side of the interior of the elevator car, which stiffens the structure and makes the fixing of a wear-resistant surface material to the floor easy. The thickness of the plate element is preferably 3-10 mm, more preferably 4-8 mm, most preferably 5-7 mm.

In a more refined embodiment of the concept according to the invention the aforementioned roof beams are in their length such that they cover preferably at least most of the length and width of the car box of the elevator car in the plane direction.

In a more refined embodiment of the concept according to the invention the horizontal distance between the aforementioned horizontal parallel roof beams is at most 2000 mm, preferably at most 1500 mm, most preferably at most 1000 mm. In this way the roof beam structure is sufficiently rigid to function as a part of the load-bearing frame structure of the car box.

In a more refined embodiment of the concept according to the invention the aforementioned vertical beams are in their length such that they cover preferably at least most of the vertical height of the elevator car.

In a more refined embodiment of the concept according to the invention the aforementioned vertical beams are rigidly fixed to the aforementioned floor element. In this way the floor element is firmly positioned and withstands standing and at the same time stiffens the load-bearing frame structure of the car box.

In a more refined embodiment of the concept according to the invention the frame structure of the car box comprises one or more vertical stiffeners, which is fixed to the aforementioned roof beam and to the aforementioned floor element for joining them rigidly together, and that the aforementioned vertical stiffener extends vertically from the roof beam right to the floor element for the distance of at least most of the length of the vertical beams. In this way the frame structure of the car box is durable and the stiffening effect of the frame structure is considerable.

In a more refined embodiment of the concept according to the invention the roof structure of the car box of the elevator car comprises one or more functional roof elements, the bottom surface of which roof element is placed against the top surfaces of the profile of the roof beams. Thus the aforementioned roof element is in the vertical direction simply supported in its position and withstands well the vertical loading exerted from outside on the surface of the roof element.

In a more refined embodiment of the concept according to the invention the roof structure of the car box of the elevator car comprises one or more functional roof elements, of rectangular shape and on the horizontal plane, which roof element comprises along its long sides essentially vertical and horizontal folds of a height of preferably at most 50 mm, even more preferably at most 30 mm, most preferably at most 20 mm. The folds function as profile stiffeners and as male-female-type joint surfaces between the roof elements. By the aid of the folds, different roof elements can be rigidly connected to each other also in the horizontal direction and the roof structure becomes tight and durable to loading from the plane direction and orthogonally to the plane direction of the roof.

In a more refined embodiment of the concept according to the invention the roof structure of the car box of the elevator car comprises one or more functional roof elements, which functional roof element comprises a luminaire, preferably a LED light source, even more preferably a LED light strip, integrated into one or more roof elements for lighting the interior of the elevator car.

In a more refined embodiment of the concept according to the invention the roof structure of the car box of the elevator car comprises one or more functional roof elements, which functional roof element comprises a fan element and/or an air-conditioning element integrated into the roof element for arranging ventilation or air-conditioning of the interior of the elevator car.

In a more refined embodiment of the concept according to the invention the roof structure of the car box of the elevator car comprises one or more functional roof elements, which roof element comprises an emergency exit hatch integrated into the roof element. Opening of the aforementioned emergency exit hatch is possible from the roof of the elevator and changing the opening side of the aforementioned emergency exit hatch to the inside of the elevator is possible. In addition, the aforementioned hatch can be made to be openable from both sides. In a more refined embodiment of the concept of the invention the locking of the emergency exit hatch of the elevator is arranged with the already existing locks/locking systems. Preferably the locking of the emergency exit hatch is handled with a lock package, which is used with a Triangel key. In one embodiment of the invention electrical circuit-breakers of the safety circuit and the necessary locking elements, such as e.g. pins, are added to the roof element of the elevator for locking the aforementioned hatch to the frame.

In a more refined embodiment of the concept according to the invention the roof structure of the car box of the elevator car comprises one or more functional roof elements, which roof element comprises an emergency exit ladder integrated into the roof element. The emergency exit ladder is integrated into the roof element and it can be lowered inside into the elevator car for exiting via an emergency exit hatch.

In a more refined embodiment of the concept according to the invention the roof structure of the car box of the elevator car comprises different functional roof elements. Thus the roof structure of the elevator car can be assembled according to varying structural and visual needs. Thus it is advantageous to assemble the roof structure according to the operating site to include the necessary functional elements and/or communication cabling and/or electrical wiring. Thus also the material and location of the functional roof elements in the roof structure of the car box of the elevator car can be varied preferably according to the regulations and needs of the operating site.

In a more refined embodiment of the concept according to the invention the roof structure of the car box of the elevator car comprises one or more functional roof elements of rectangular shape, the long side of which roof element is essentially the width of the elevator car in length and the short side can be selected from between preferably 200-1000 mm, even more preferably from between 300-800 mm, even more preferably from between 350-500 mm.

In a more refined embodiment of the concept according to the invention the roof structure of the car box of the elevator car comprises one or more functional roof elements, which comprises a sound-damping element integrated into the roof element. Preferably the sound-damping element is a rectangularly-shaped covering, essentially of the size of the roof element, fabricated from non-combustible material, which is fixed to the inner surface and/or to the outer surface of the roof element. The sound damping material is preferably e.g. mineral wool coated with glass fabric.

In a more refined embodiment of the concept according to the invention the roof structure of the car box of the elevator car comprises one or more functional roof elements, which comprises a bottom surface, which forms a surface bounding the interior, and that the bottom surface and top surface of the aforementioned roof element are at a vertical distance from each other such that a space is formed between them, in which space air is preferably conducted to travel between the interior and the elevator hoistway and/or electricity cables and/or communications cables. In this way the space of the roof of the elevator car can be efficiently utilized.

In a more refined embodiment of the concept according to the invention a functional roof element of the car box of the elevator car is supported against the aforementioned roof beams from below, which functional roof element comprises a bottom surface, which forms a surface bounding the interior. Thus the structure is very compact.

In a more refined embodiment of the concept according to the invention the structure of at least one luminaire integrated into the aforementioned functional roof element, preferably at least the light source and/or the reflective surface of the luminaire, is at least partly, preferably fully, beside the roof beam i.e. in the vertical direction at the point of the roof beam. Thus the structure is very compact.

In a more refined embodiment of the concept according to the invention the cross-sectional profile of each vertical beam of the aforementioned car box comprises a vertical side surface, the width of which is preferably at least 10 mm, even more preferably at least 20 mm, most preferably at least 30 mm. Thus good rigidity and a compact structure are obtained for the vertical beams.

In a more refined embodiment of the concept according to the invention the cross-sectional profile of each roof beam of the aforementioned car box comprises a horizontal top surface, the width of which is preferably at least 10 mm, even more preferably at least 20 mm, most preferably at least 30 mm. Thus good rigidity and a shallow structure are obtained for the roof beam.

In a more refined embodiment of the concept according to the invention the elevator car is suspended with hoisting roping, which is connected to the elevator car with means, such as via a diverting pulley system or equipment for fixing the ropes, which means are on the side of or below the elevator car.

In a more refined embodiment of the concept according to the invention the elevator car is suspended with hoisting roping, which is connected to the elevator car such that it supports the elevator car via a diverting pulley system supported on the elevator car.

In a more refined embodiment of the concept according to the invention the elevator car is suspended with hoisting roping passing around and below the elevator car.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

BRIEF DESCRIPTION OF THE FIGURES

The invention will now be described mainly in connection with its preferred embodiments, with reference to the attached drawings, wherein.

DETAILED DESCRIPTION OF THE INVENTION

FIGS. 1-3*d* present the structure of a car box I of an elevator car according to one embodiment of the invention.

Figure 1:
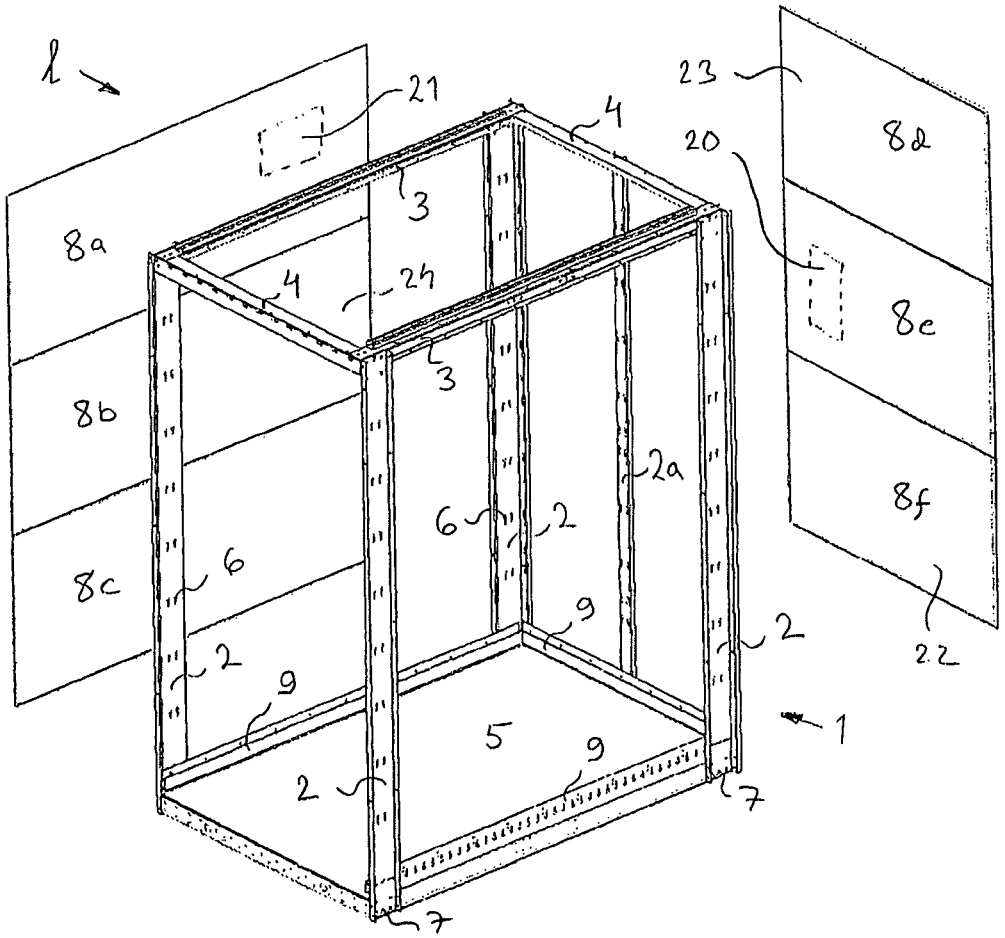
FIG. 1 presents a frame structure, with functional wall elements, of the car box of an elevator car according to one embodiment of the invention.

FIG. 1 presents the frame structure 1 of the car box I of an elevator car according to one embodiment of the invention, which frame structure comprises four elongated vertical beams 2 and two horizontal, parallel, first elongated roof beams 3 in connection with the roof and fixed to the vertical beams 2 and two horizontal, parallel, second elongated roof beams 4 at a distance from each other and essentially orthogonal to the roof beams 4, which adjacent roof beams 3 and 4 are fixed to each other, and an interior, which is bounded by a space bordered by at least a planar floor element 5 of rectangular shape and the vertical beams 2 and the roof beams 3 and 4.

The vertical beams 2 of the frame structure of the car box are C-profile beams opening outwards from the interior, which profile beams have essentially the same continuous cross-sectional profile in the longitudinal direction of the beam. Cuttings and apertures 6 are arranged in the vertical beams for fixing means for fixing the functional wall elements 8*a*-8*f* to the vertical beams. The vertical beams 2 of the frame structure 1 of the car box I are rigidly fixed with fixing means 7 to the vertical side edges of a planar floor element 5 of rectangular shape at the bottom edge of a vertical beam 2 and to the horizontal first roof beams 3 at the top edge of a vertical beam 2. In one embodiment of the invention a vertical length stiffener 2*a* is added to the frame structure 1 of the car box I of the elevator for increasing the stiffening effect of the frame structure of the car box.

The rectangular, planar, functional wall elements 8*a*-8*f* presented in FIG. 1 comprise one or more of the following functional features:

- sound-damping cladding 22 integrated into the element,
- a passenger user interface 20 integrated into the element,
- an elevator control unit 21 integrated into the element,
- one or more ventilation openings integrated into the element,
- communications cables and/or electricity cables, between a device of the elevator car and a control unit of the elevator car and/or an electricity source, integrated into the element,
- a mirror 23 integrated into the element, and/or
- a decorative surface 24 integrated into the element for covering an open point on the wall surface.

FIG. 1 presents the aforementioned functional wall elements 8*a*-8*f*, which extend essentially from one side of the elevator car to the other and which are fixed with fixing means at least to the vertical beams 2. In the figure the functional wall elements 8*a*-8*f* are presented as distributed horizontally, i.e. the aforementioned wall elements are fixed to the frame structure 1 of the elevator car one on top of another in the vertical direction. The bottommost wall element is supported in a support element 9 and the topmost wall element is additionally fixed with fixing means to a roof beam 3 and/or 4 of the frame of the elevator car. The functional wall elements can also be distributed vertically, in which case the aforementioned wall elements would extend essentially from a support element 9 up to a roof beam 3 or 4 and the aforementioned wall elements could be fixed to the frame structure 1 of the elevator car one beside another in the horizontal direction, e.g. by fixing the functional wall elements with fixing means to the roof beams 3 or 4, to the vertical beams 2 and/or to a vertical stiffener 2*a*.

Figure 2:
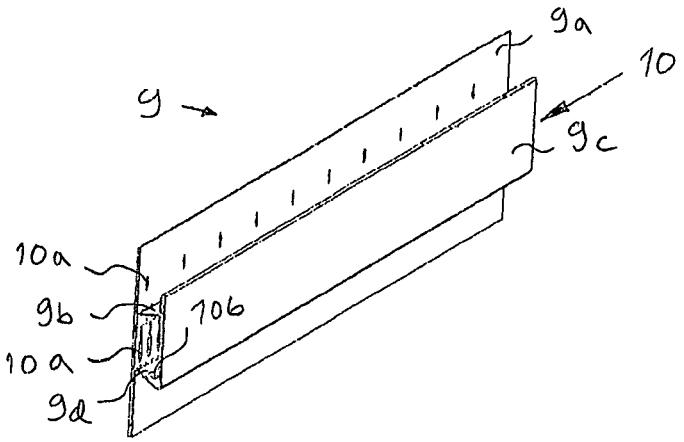
FIG. 2 presents a support element of a functional wall element of a car box of an elevator car according to one embodiment of the invention.

FIG. 2 presents a support element 9 of the functional wall elements 8*a*-8*f* of a car box of an elevator car according to one embodiment of the invention. In the immediate proximity of the planar floor element 5 of rectangular shape, support elements 9 of the wall elements are rigidly fixed to the vertical beams 2 of the elevator car, which support elements comprise in their cross-sectional shape a closed profile, inside which is integrated a ventilation duct 10 for arranging the ventilation and/or air-conditioning of the elevator car. The cross-section of the profile comprises two long parallel sides 9*a* and 9*c* in the vertical direction and two short sides 9*b* and 9*d* connecting them. Apertures 10*a* are arranged in the first long side 9*a* of the cross-section of the profile, for leading in fixing means for the fixing of the support elements 9 to the vertical beams 2. The second long side 9*c* of the cross-section of the profile comprises on an extension of the long side a flange, which forms an elongated channel-like space on the top surface of the support element 9, on which the aforementioned functional wall element is supported in the lateral direction at its bottom edge. The first short side 9*b* of the cross-section of the profile comprises a horizontal detent surface, on which the aforementioned wall element is supported in the vertical direction. The second short side 9*d* of the cross-section of the profile comprises an inclined side 9*d*, preferably at an angle of 30-60 degrees to the horizontal, which comprises flow apertures 10*b* for ventilating air for arranging ventilation and/or air-conditioning in the elevator car.

Figure 3A:
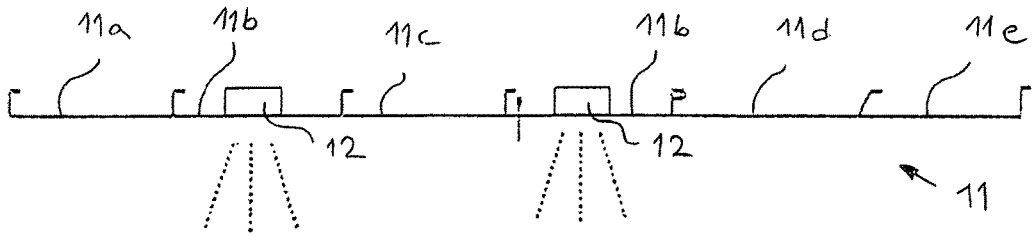
FIG. 3*a* indicatively presents a roof structure of a car box of an elevator car assembled from roof elements differing in their functionality according to one embodiment of the invention.

FIG. 3*a* presents an indicative view of a roof structure 11 of the car box of an elevator car according to the invention, which comprises one or more functional roof elements 11*a*-11*e*, the bottom surface of which roof element 11*a*-11*e* is placed against the top surfaces of the profile of the roof beams 3, in which case the roof element 11*a*-11*d* is simply supported in its position in the vertical direction and withstands well loading exerted on the roof element from outside that is orthogonal to the plane.

Figure 3B:
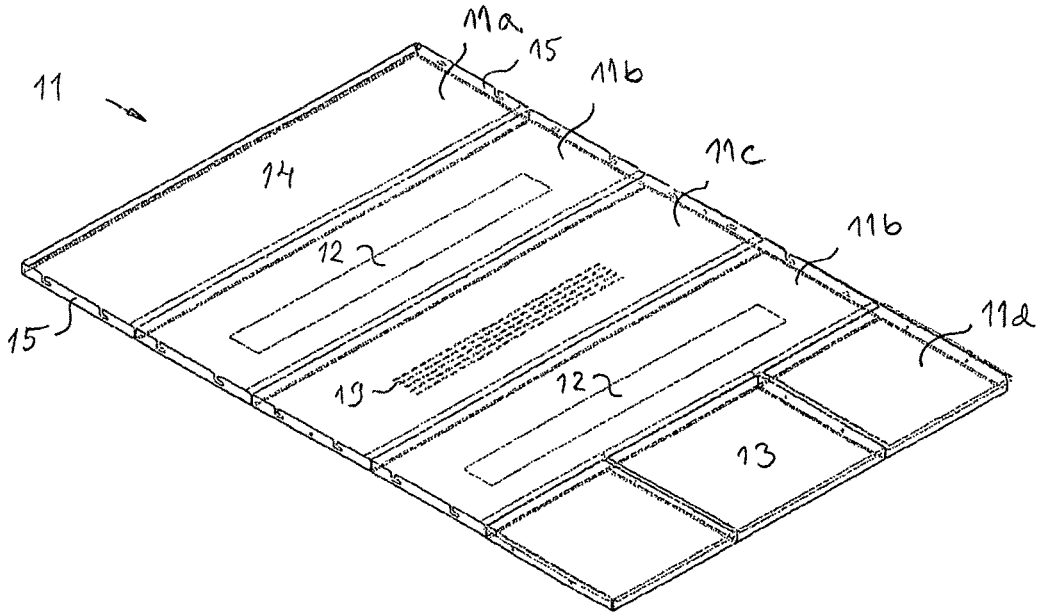
FIG. 3*b* presents a three-dimensional oblique top view of a roof structure of a car box of an elevator car assembled from roof elements differing in their functionality according to one embodiment of the invention

The functional roof elements 11*a*-11*e* presented in FIG. 3*b* comprise one or more of the following functional features:

- sound-damping cladding integrated into the element 11*a*,
- one or more luminaires 12, for lighting the interior of the elevator car, integrated into the element 11*b*,
- an air-conditioning element and/or a ventilation element integrated into the element 11*c*, and/or one or more ventilation openings 19, for arranging air-conditioning and/or ventilation of the interior of the elevator car,
- an emergency exit hatch 13 integrated into the element 11*d*,
- a decorative surface 11*e* integrated into the element for covering an open point on the roof surface,
- an emergency exit ladder integrated into the element,
- communications cables and/or electricity cables, between a device of the elevator car and a control unit of the elevator car and/or an electricity source, integrated into the element The functional roof element 11*a* according to the invention presented in FIG. 3*b* comprises a sound-damping element integrated into the roof element. The sound-damping element is preferably a non-combustible covering of rectangular shape and of essentially the size of the roof element, which is fixed to the outer surface of the roof element. The sound damping material is preferably e.g. mineral wool coated with glass fabric.

The functional roof element 11*b* according to the invention presented in FIG. 3*b* comprises a luminaire 12, preferably a LED light source, integrated into the roof element for lighting the interior of the elevator car. The roof element 11*b* forms at least a part of the inner wall of the casing, into which casing the aforementioned luminaire is disposed. The roof element is arranged to be opened from above the roof of the car, for servicing, replacing or installing a luminaire.

The functional roof element 11*c* according to the invention presented in FIG. 3*b* comprises a ventilation element and/or an air-conditioning element integrated into the roof element. At their simplest, the venting and ventilation are implemented with ventilation ducts and ventilation apertures 19 arranged in a roof element, which in the figure are presented as elongated apertures in the center part of the roof element. The ventilation apertures can also be perforations and/or punchings and/or elongated apertures in the center part of the roof element and/or on the edges of same. The roof element can also comprise a fan element, with which air is supplied under pressure into the elevator car for boosting the air flow. The roof element can also comprise an air-conditioning element, with which air is cooled or warmed before being supplied into the elevator car.

The functional roof element 11*d* according to the invention presented in FIG. 3*b* comprises an emergency exit hatch 13 integrated into the roof element. The emergency exit hatch is a rectangularly-shaped planar element, and comprises brackets on its opposite sides for a pivoting arrangement of the hatch. The frame structure of the emergency exit hatch integrated into the aforementioned roof element comprises an aperture, which the aforementioned hatch is arranged to cover. The aforementioned planar hatch element and/or the aforementioned frame structure is/are manufactured from a plate element and the supporting of the hatch on the frame structure is implemented with folds in the plate element of the aforementioned hatch. The emergency exit hatch can also comprise pivot brackets implemented with folds on its opposite sides and the aperture can comprises folds with pivot apertures on its opposite sides, for receiving the aforementioned pivot brackets. The emergency exit hatch presented in the figure is disposed in the center part of a roof element, but preferably the emergency exit hatch can also extend to essentially from one edge side of the elevator car to another.

FIG. 3*b* presents a roof of an elevator car comprising functional roof elements 11*a*-11*d* according to the invention, of rectangular shape and on a horizontal plane. FIG. 3*b* presents functional roof elements 11*a*-11*d* in a certain sequence, but a roof structure comprising roof elements can be assembled according to varying structural and visual needs from materials specified by the customer and in a sequence specified by the customer. It is advantageous to assemble the roof structure according to the operating site to include the necessary functional elements and/or communication cabling and/or electrical wiring. In this way also the location of roof elements, and thereby of functions, in the roof structure of an elevator car can be optimized according to the regulations and needs of the operating site.

Figure 3C:
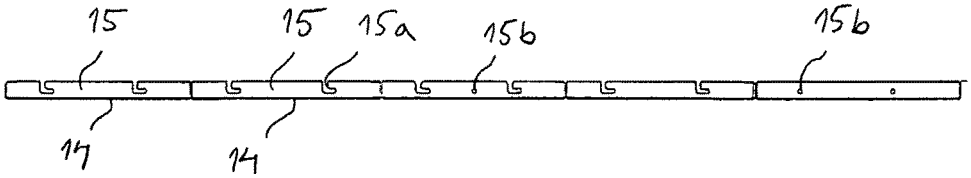
FIG. 3*c* presents a side view of the roof structure of a car box of an elevator car assembled from roof elements differing in their functionality according to FIG. 3*b*.
Figure 3D:
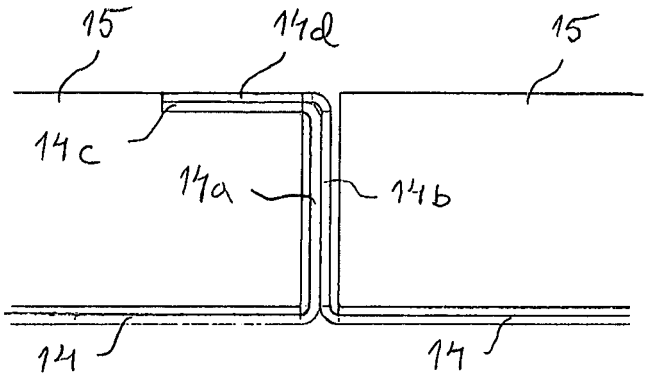
FIG. 3*d* indicatively presents a point of connection of the functional roof elements of the roof structure of a car box of an elevator car according to FIG. 3*c*.

FIG. 3*c* presents a side view of a roof of an elevator car comprising functional roof elements 11*a*-11*d* according to the invention and FIG. 3*d* a magnification of a point of connection between roof elements. A functional roof element comprises a planar plate element 14 of rectangular shape, which plate element comprises along its long sides essentially vertical folds 14*a*, 14*b* and essentially horizontal folds 14*c*, 14*d* of a height and width of preferably at most 50 mm, even more preferably at most 40 mm. The horizontal fold 14*d* on the first long side of the plate element is implemented outwards from the plate element and the horizontal fold 14*c* on the second long side of the plate element is implemented inwards from the plate element. On the opposite short sides of the aforementioned plate element 14 are essentially vertical folds 15, in height of essentially the same height as the folds 14*a*, 14*b* of the long sides. L-shaped machinings 15*a* and/or apertures 15*b* are arranged in the folds 15 on the opposite short sides for the lead-ins of the fixing means for fixing the roof elements to the top horizontal beam 3 of the frame of the elevator car. The long side of a plate element is essentially the width of the elevator car in length and the short side can be selected according to customer needs.

The folds 14*a*-14*d*, 15 further stiffen the roof element and different roof elements can be tightly connected to each other also in the horizontal direction and the roof structure becomes rigid and durable to loading from the plane direction and orthogonally to the plane direction of the roof. In addition, the folds improve the sound damping of the points of connection of the roof elements.

All the joints referred to in this application can be implemented mechanically by connecting, e.g. with a screw and nut, by riveting, by welding or by glueing. The joint means can comprise a screw, a nut, a rivet, a stud, a nail or some other corresponding element suited to joining.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. An elevator car comprising:

a car box, the car box including a frame structure having a rectangular prism shape, the frame structure including a planar, rectangular-shaped floor element, at least four vertical beams fixed to the floor element at respective bottom edges of the vertical beams, the vertical beams fixed to the floor element proximate to separate, respective corners of the floor element, at least two horizontal, parallel, first roof beams connected to separate, respective pairs of the at least four vertical beams at respective top edges of the vertical beams, and at least two horizontal, parallel, second roof beams extending orthogonally in relation to the first roof beams, the second roof beams extending between separate respective pairs of the at least four vertical beams, adjacent first roof beams and second roof beams fixed to each other, wherein the floor element, the at least four vertical beams, the first roof beams, and the second roof beams bound a rectangular prism-shaped interior of the car box;

a plurality of walls in the rectangular prism-shaped interior bounded by the frame structure, each wall defined by a plurality of planar wall elements of rectangular shape inside the frame structure, the plurality of planar wall elements fixed side-by-side to the frame structure and extending from one edge side of the car box to another, such that the plurality of walls bound sides of a free interior for receiving and transporting freight and/or passengers within the rectangular prism-shaped interior bounded by the frame structure; and a roof including a plurality of planar roof elements of rectangular shape fixed side-by-side on top surfaces of the first roof beams, wherein the plurality of planar wall elements is a first element group, the first element group including a first element and a second element, the first element and the second element having separate, respective integrated functionalities, such that a first integrated element having a first functionality is integrated into the first element, and a second integrated element having a second functionality integrated into the second element, the second functionality being different from the first functionality, the first integrated element not having the second functionality and the second integrated element not having the first functionality, and wherein the plurality of planar wall elements are stacked vertically to form each wall of the plurality of walls such that each wall element of the plurality of planar wall elements extends from one vertical beam of the at least four vertical beams to another vertical beam of the at least four vertical beams.

2. The elevator car according to claim 1, wherein each of the first integrated element and the second integrated element is a different one of:

a passenger user interface integrated into the given element, an elevator control unit integrated into the given element, or a mirror integrated into the given element.

3. The elevator car according to claim 1, wherein each element of the first element group includes a first long side and a second long side, at least one element of the first element group is side-by-side with an adjacent element of the plurality of planar roof elements or the plurality of planar wall elements, such that the first long side of the at least one element forms a counterpair to the second long side of the adjacent element to form a male-female-type joint between the at least one element and the adjacent element.

4. The elevator car according to claim 1, wherein one of the plurality of planar roof elements has a luminaire integrated into the one of the plurality of planar roof elements, the luminaire being a light emitting diode (LED) light strip that is integrated into the one of the plurality of planar roof elements such that the LED light strip is configured to light the interior of the car box.

5. The elevator car according to claim 1, wherein at least one planar roof element of the plurality of planar roof elements includes an integrated element that is a ventilation element and/or an air-conditioning element.

6. The elevator car according to claim 1, wherein at least one planar roof element of the plurality of planar roof elements includes an emergency exit hatch.

7. The elevator car according to claim 1, wherein at least one planar roof element of the plurality of planar roof elements includes a sound-damping cladding.

8. The elevator car according to claim 1, wherein at least one planar roof element of the plurality of planar roof elements includes an integrated element that is a ventilation duct and/or ventilation opening.

9. The elevator car according to claim 1, wherein the floor element is a planar sandwich structure that includes surface plates of a sandwich board and a core material, the core material is a honeycomb structure or a flute profile bent from metal or a honeycomb fabricated from thermoplastic, the surface plates of the sandwich board include a metal material, and the surface plates are fixed to the core material by welding, gluing or riveting.

10. The elevator car according to claim 1, wherein the floor element is a planar sandwich structure that includes surface plates of a sandwich board and a core material, the surface plates are of a thickness of 0.5-5 mm, and a thickness of the core material of the sandwich board is 10-100 mm.

11. The elevator car according to claim 1, wherein the floor element is a planar sandwich structure, profile elements are connected to side edges of the planar sandwich structure of the floor element, the profile elements including a metal material in which apertures are arranged for joint elements.

12. The elevator car according to claim 1, wherein a plate-like element that covers the floor element is connected to a surface of the floor element that faces the free interior of the car box, the plate-like element is configured to stiffen the frame structure and facilitate a fixing of a wear-resistant surface material to the floor element, and a thickness of the plate-like element is 3-10 mm.

13. The elevator car according to claim 1, wherein the at least four vertical beams and the first roof beams are profile beams, the at least four vertical beams and the first roof beams having a common continuous cross-sectional profile in a longitudinal direction of the respective beams, a width/height ratio of a cross-section of each beam of the at least four vertical beams and the first roof beams at least 0.5.

14. The elevator car according to claim 1, wherein the plurality of planar roof elements and the plurality of planar wall elements include respective outer surfaces that at least partially comprise a visible outer surface of the car box of the elevator, or the plurality of planar roof elements and the plurality of planar wall elements include respective inner surfaces that at least partially comprise a visible inner surface bounding the interior of the car box of the elevator.

15. The elevator car according to claim 1, wherein the car box includes a ventilation arrangement, wherein air is conducted between the free interior of the car box and a space outside the car box, via a ventilation duct and flow apertures included in support elements of the plurality of planar wall elements.

16. An elevator, comprising:

an elevator hoistway; and the elevator car according to claim 1.

17. An elevator car comprising:

a car box, the car box including a frame structure having a rectangular prism shape, the frame structure including a planar, rectangular-shaped floor element, at least four vertical beams fixed to the floor element at respective bottom edges of the vertical beams, the vertical beams fixed to the floor element proximate to separate, respective corners of the floor element, at least two horizontal, parallel, first roof beams connected to separate, respective pairs of the at least four vertical beams at respective top edges of the vertical beams, and at least two horizontal, parallel, second roof beams extending orthogonally in relation to the first roof beams, the second roof beams extending between separate respective pairs of the at least four vertical beams, adjacent first roof beams and second roof beams fixed to each other, wherein the floor element, the at least four vertical beams, the first roof beams, and the second roof beams bound a rectangular prism-shaped interior of the car box;

a plurality of walls in the rectangular prism-shaped interior bounded by the frame structure, each wall defined by a plurality of planar wall elements of rectangular shape inside the frame structure, the plurality of planar wall elements fixed side-by-side to the frame structure and extending from one edge side of the car box to another, such that the plurality of walls bound sides of a free interior for receiving and transporting freight and/or passengers within the rectangular prism-shaped interior bounded by the frame structure; and a roof including a plurality of planar roof elements of rectangular shape fixed side-by-side on top surfaces of the first roof beams, wherein the plurality of planar wall elements includes a first planar wall element and a second planar wall element, the first planar wall element and the second planar wall element having separate, respective integrated functionalities, such that a first integrated element having a first functionality is integrated into the first planar wall element, and a second integrated element having a second functionality is integrated into the second planar wall element, the second functionality being different from the first functionality, the first planar wall element not having the second functionality and the second integrated wall element not having the first functionality, and wherein the plurality of planar wall elements are stacked vertically to form each wall of the plurality of walls such that each planar wall element of the plurality of planar wall elements extends from one vertical beam of the at least four vertical beams to another vertical beam of the at least four vertical beams.

* * * * *